United States Patent [19]

Davey

[11] Patent Number: 4,475,335

[45] Date of Patent: Oct. 9, 1984

[54] FREE PISTON HEAT ENGINES

[75] Inventor: Gordon Davey, Cumnor Hill, England

[73] Assignee: National Research Development Corporation, London, England

[21] Appl. No.: 463,504

[22] Filed: Feb. 3, 1983

[30] Foreign Application Priority Data

Feb. 12, 1982 [GB] United Kingdom ..... 8204165

[51] Int. Cl.[3] ..... F02G 1/04

[52] U.S. Cl. ..... 60/520; 92/130 B; 92/130 C

[58] Field of Search ..... 60/520; 92/130 B, 130 C

[56] References Cited

U.S. PATENT DOCUMENTS 3,828,558 8/1974 Beale ..... 60/520

4,183,214 1/1980 Beale et al. ..... 60/520

*Primary Examiner*—Allen M. Ostrager

*Attorney, Agent, or Firm*—Cushman, Darby & Cushman

[57] ABSTRACT

A Stirling cycle heat engine, specially suitable for use in environments subject to acceleration or large temperature variations, including a free and reciprocating displacer piston fitted with a non-contact device which acts with increasing force to oppose further movement whenever the piston overshoots desired limits of its movement. The device may include a magnet which is carried by the piston shaft and which experiences repulsion from like poles of magnets carried by the shaft housing.

6 Claims, 1 Drawing Figure

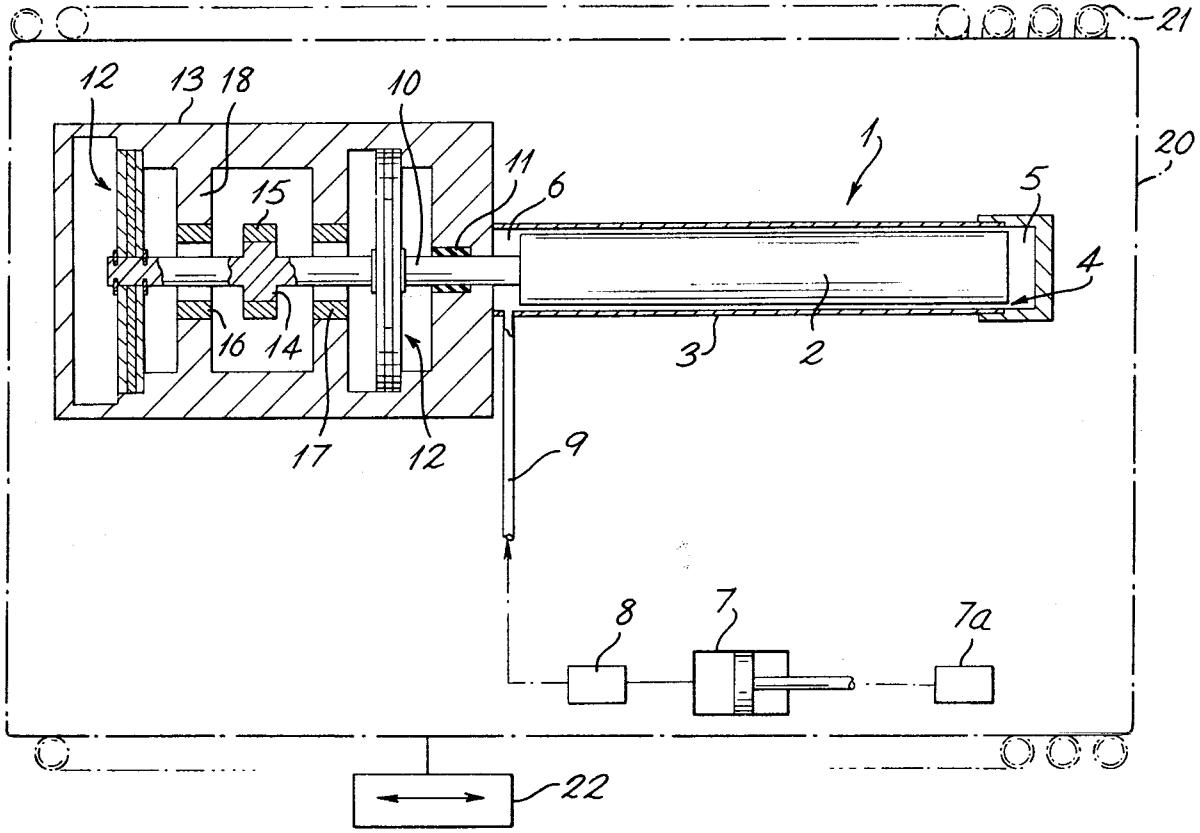
21
20
4
5
1
2
3
6
11
10
12
17
15
14
16
18
13
12
9
7a
7
8
22

FREE PISTON HEAT ENGINES

This invention relates to heat engines, especially those employing the Stirling thermodynamic cycle. Stirling engines, as is well known, contain at least one of each of two essential moving parts, the movements of which are similar but must be out-of-phase with each other within certain limits. One of these parts is usually known as the displacer, and often comprises a plunger or piston movable with clearance within a cylinder whereby to transfer a mass of gas in alternate directions between the two ends of the cylinder. It is a characteristic of the cycle that one end of the displacer becomes or is maintained cold relative to the other, hence the use of Stirling engines (working as heat pumps) in refrigerators. The relatively hot end of the displacer is connected by way of a heat exchanger to the other essential moving part of the engine, which typically comprises a piston movable within a cylinder and will be referred to as the compressor. This moving part constitutes the interface between the machine and mechanical work: when the engine is acting as a heat pump the piston of this part is externally driven. If however the engine is to work in the reverse sense, then external power is used to maintain the appropriate temperature difference between the two ends of the displacer. The resulting pulsations of pressure within the engine drive the piston of the compressor so that it can perform external mechanical work.

It is known for the displacer and compressor pistons of Stirling engines, and indeed for comparable moving parts of other heat engines, to be connected to rigid mechanical linkages that positively determine their exact positions at all times. However it is also known for such pistons to be "free", that is to say to be suspended by fluid or mechanical springs so that their exact positions are not so determined. The present invention applies to heat engines having at least one free piston as so defined, and especially to Stirling engines in which not only the displacer piston but also the compressor piston may be free. For instance the compressor piston may be connected to an electromagnetic device that acts as a motor to drive the compressor when the engine is acting as a heat pump, and that acts as a generator driven by the compressor when it is acting in the reverse sense.

The need for the present invention is demonstrated particularly by the type of Stirling cycle heat pump in which the piston of the displacer is specially "free", being neither positively driven nor linked to the movements of the compressor in any way other than through the medium of the working fluid of the machine. In such a Stirling engine the displacer is simply so designed that its free response to the movements of the compressor, as reflected by changes in the velocity and pressure of the working fluid, is such that it oscillates at the same frequency as the compressor but at an appropriate phase shift. The "Beale"-type machine is one known Stirling engine that works in this way. Such a machine has evident potential advantages in simplicity and therefore in cost over those in which the movements of the displacer are either positively driven or subject to external control. What is more, the design of such "free response" mechanisms has reached the point where the optimum phase-relationship between the movements of the compressor and displacer is obtained within close limits, so that the efficiency attainable with such mechanisms compares favourably with those in which the displacer is not free. However, Stirling cycle engines find frequent use in cryogenic refrigerators and other plant in which the engine will be subjected to large variations of temperature, and this creates a problem for "free response" machines as just decribed. Having arranged for the compressor and displacer strokes to be of the correct amplitude at say room temperature, as the temperature falls the reciprocating parts will tend to overshoot. This reduces performance, causes often unacceptable noise and may lead to mechanical failure. The tendency is especially great if the equipment containing the engine is not stationary but is subject to acceleration.

The present invention aims to provide a simple, maintenance-free way of countering any such tendencies for the amplitude of the stroke of "free" pistons to change in such conditions. According to the invention a free piston of a heat engine includes a non-contact device which acts with increasing force to oppose further movement whenever the piston overshoots predetermined limits of its reciprocatory movement. The device may be of magnetic type, giving rise to forces of repulsion between like magnetic poles. For instance the piston may carry a magnet, mounted for example on the piston shaft, and two magnets may be fixed to the shaft housing so that a first pole of the moving magnet approaches a like pole of one of the fixed magnets when the piston tends to overshoot in one direction, and the second pole of the moving magnet approaches a like pole of the second fixed magnet when there is overshoot in the opposite direction. The magnets should be of Samarium Cobalt or other type that will withstand strong demagnetising fields. The piston may be the compressor piston, or more especially the displacer piston, of a Stirling cycle engine, and the heat engine may be located in an environment where it may be subject to large variations of temperature and/or to acceleration.

The invention will now be described, by way of example, with reference to the accompanying drawing which is a diagrammatic axial section through a Stirling engine displacer.

The displacer 1 comprises a free piston 2 mounted to reciprocate within a cylinder 3 from which it separated by a small annular clearance 4. The walls of this clearance act as a regenerative heat exchanger, and movement of the piston to and fro within the cylinder causes gas to be displaced through clearance 4 in alternate directions between the blind or distal end 5 of the cylinder and the opposite end 6. Such movement results from the free response of piston 2 to the movements of the free piston (connected to an electromagnetic device 7*a*) of the compressor 7, those movements being reflected in movement of the working gas of the machine which reaches end 6 of the displacer by way of a heat exchanger 8 and a conduit 9. Oscillation of piston 2 in response to the movements of the piston of the compressor 7 causes end 5 to become relatively cold and end 6 relatively warm, so that the machine acts as a heat pump and end 5 may be used as the power source of a refrigeration unit.

Piston 2 carries a shaft 10 which passes through a gas-tight seal 11 and carries two flat spiral springs 12 by which it is mounted within a fixed housing 13. The springs 12 flex readily in the axial direction but are very stiff radially and so hold rod 10 and piston 2 accurately to axial reciprocation.

Shaft 10 carries a boss 14 around which a circular magnet 15 is mounted, and two similar magnets 16, 17 are mounted on flanges 18 projecting inwardly from the wall of housing 13, so that magnet 16 lies axially to one side of magnet 15 and magnet 17 lies axially to the other side. The polarity of magnets 15, 16 and 17 is arranged with like poles adjacent, so that as magnet 15 approaches either of the other two it is opposed by an increasing repulsive force, so opposing any tendency of piston 1 to overshoot its proper amplitude of movement as a result, for example, of a change in the temperature or of acceleration to which displacer 1 has been subjected. The means whereby the engine may be subjected to changes of temperature or to acceleration are illustrated diagrammatically: the engine is shown as being mounted within a container 20 wound with refrigerating coils 21, and connected to a prime mover 22.

As shown in the drawing, as magnet 15 approaches either of the other two then the force of repulsion that it experiences will vary in an inverse manner relative to the distance between them. The force-distance curve depends on many factors including the shape of the magnets, their length-to-pole area, the ratio between the size of the pole faces and the distance between repelling magnets, etc. Hence it is possible to alter the damping characteristics of the system within wide limits by altering one or more of such geometrical features.

I claim:

1. A heat engine comprising:

a free piston, adapted to execute reciprocatory movement of predetermined maximum stroke, and a non-contact movement-resisting device associated with said piston, said non-contact device being located so as to oppose further said reciprocatory movement with increasing force whenever said piston approaches either end of said stroke.

2. A heat engine according to claim 1 in which said non-contact device is of magnetic type and gives rise to forces of repulsion between like magnetic poles.

3. A heat engine according to claim 1 including a piston shaft attached to said piston and a stationary housing surrounding said shaft, and in which said non-contact device includes a first magnet attached to said shaft and two second magnets fixed to said housing, so arranged that a first pole of said first magnet approaches a like pole of one of said second magnets when said piston approaches a first end of said stroke, and so that a second pole of said first magnet approaches a like pole of the other said second magnet when said piston approaches the second end of said stroke.

4. A Stirling thermodynamic cycle heat engine according to claim 1 including a displacer piston and a compressor piston, in which said free piston is said displacer piston.

5. A Stirling thermodynamic cycle heat engine according to claim 1 including a displacer piston and a compressor piston, in which said free piston is said compressor piston.

6. A Stirling thermodynamic cycle heat engine according to claim 1 including a surrounding container attached to means for creating acceleration and large variations of temperature.

* * * * *